US007517245B2

(12) United States Patent
Braathen

(10) Patent No.: US 7,517,245 B2
(45) Date of Patent: Apr. 14, 2009

(54) UNIVERSAL MODULAR SUPPORT BRACKET ASSEMBLY

(76) Inventor: Odin Braathen, 472 Costa Mesa St., Costa Mesa, CA (US) 92627

( * ) Notice: Subject to any disclaimer, the term of this patent is extended or adjusted under 35 U.S.C. 154(b) by 33 days.

(21) Appl. No.: 11/639,173

(22) Filed: Dec. 14, 2006

(65) Prior Publication Data

US 2008/0146078 A1 Jun. 19, 2008

(51) Int. Cl.
*H01R 13/60* (2006.01)

(52) U.S. Cl. ..... 439/538; 174/54

(58) Field of Classification Search ..... 439/535, 439/538, 539; 174/53, 54, 66, 67
See application file for complete search history.

(56) References Cited

U.S. PATENT DOCUMENTS

| | | | | | |
|---|---|---|---|---|---|
| 3,437,737 | A | | 4/1969 | Wagner | |
| 3,770,872 | A | * | 11/1973 | Brown | 174/53 |
| 4,012,580 | A | * | 3/1977 | Arnold | 174/53 |
| 4,059,327 | A | | 11/1977 | Vann | |
| 4,134,636 | A | | 1/1979 | Kleinatland et al. | |
| 4,247,738 | A | | 1/1981 | Bonato | |
| 4,948,317 | A | * | 8/1990 | Marinaro | 411/535 |
| 5,041,698 | A | | 8/1991 | Takagi et al. | |
| 5,064,386 | A | | 11/1991 | Dale et al. | |
| 5,073,681 | A | | 12/1991 | Hubben et al. | |
| 5,180,886 | A | | 1/1993 | Dierenbach et al. | |
| 5,189,259 | A | * | 2/1993 | Carson et al. | 174/66 |
| 5,221,814 | A | | 6/1993 | Colbaugh et al. | |
| 5,456,373 | A | | 10/1995 | Ford | |
| 6,005,308 | A | * | 12/1999 | Bryde et al. | 307/157 |
| 6,051,785 | A | * | 4/2000 | Baldwin et al. | 174/54 |
| 6,281,440 | B1 | | 8/2001 | Baldwin et al. | |
| 6,417,450 | B1 | | 7/2002 | Young | |
| 6,462,277 | B1 | | 10/2002 | Young et al. | |
| 6,468,107 | B1 | * | 10/2002 | Nice et al. | 439/536 |
| 6,608,253 | B1 | | 8/2003 | Rintz | |
| 6,623,296 | B2 | | 9/2003 | Okamoto | |
| 6,679,725 | B2 | | 1/2004 | Kidman | |
| 6,750,398 | B1 | * | 6/2004 | Richardson | 174/58 |
| 6,765,149 | B1 | | 7/2004 | Ku | |
| 6,906,260 | B2 | | 6/2005 | Grendahl | |
| 6,974,910 | B2 | | 12/2005 | Rohmer | |
| 7,122,740 | B2 | * | 10/2006 | Xu et al. | 174/66 |
| 7,189,928 | B2 | * | 3/2007 | Denier | 174/481 |
| 7,255,596 | B2 | * | 8/2007 | Pyrros | 439/535 |

* cited by examiner

*Primary Examiner*—Thanh-Tam T Le

(57) ABSTRACT

An electrical module support assembly for use with a junction box disposed in a building structure at a structure surface, the assembly comprising: a mounting fastener; an electrical module having a mounting portion with a module fastener aperture disposed through the mounting portion; and a support bracket defining a longitudinal axis and a lateral axis disposed perpendicular to the longitudinal axis, the support bracket having a modular face, a junction box face opposite the modular face, and a bracket fastener aperture disposed through the support bracket, the support bracket being rotatably disposable between the mounting portion and the structure surface with the modular face disposed towards the electrical module, the support bracket extending beyond the mounting portion in directions respectively along the longitudinal and lateral axes away from the support bracket with the mounting fastener disposed through the module fastener aperture and the bracket fastener aperture.

18 Claims, 6 Drawing Sheets

10
21
14
13
12
15
23
17
25
19

16
46
48
18
14
13
12
10
20
28
26
22
24
34
60

UNIVERSAL MODULAR SUPPORT BRACKET ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a universal modular support bracket assembly for the installation of a variety of light switches and outlet sockets into the junction boxes recessed within the surfaces of building structures.

A universally adaptable assembly is needed to relatively secure all types of electrical lighting modules onto the junction box recessed under a structure surface such that these modules do not fall through the opening in the structure surface made for the junction box. Such an assembly should also enable these electrical modules to be supported on the structure surface such that the underlying paint and drywall are not damaged.

There are a number of electrical module assemblies used to install electrical modules into the walls of a building. For instance, U.S. Pat. No. 4,247,738 discloses a flush-mounting electrical box assembly having a box, frame, holder frame, and outer protective cover for mounting to a building wall. The holder or support frame in this assembly is uniquely sized for use only with and accommodation of a customized frame containing an electrical module. The support frame is not designed to directly support the electrical module on the structure surface. U.S. Pat. No. 5,180,886 discloses a wall box electric device assembly disclosing a "designer" decorative cover plate, a wall plate, and a yoke plate for mounting only an electric socket onto junction box. This assembly again is specialized for use only with the customized "designer" decorative cover plate and not with standard cover plates. U.S. Pat. No. 4,134,636 discloses an electrical outlet and under plate assembly disclosing a molded plastic insulator panel sized for telescopic engagement with a junction box. The under plate extending around the interior walls of the opening for the junction box in the structure surface does not act to support the electrical module on the structure surface. In all of these prior art assemblies, the underlying paint and drywall remain exposed to wear by the electrical module abutting against the wall surface as well as to the electrical module falling into the opening created for the junction box in the structure surface.

Accordingly, there is a need in the art for an improved modular support bracket assembly able to accommodate all types of electrical modules such that they are supported above a building surface while remaining firmly attached to the recessed junction box, thereby mitigating damage by the electrical module to the underlying paint and drywall surface of the building structure or otherwise having the electrical module fall into the junction box opening.

BRIEF SUMMARY

According to an aspect of the present invention, there is provided an electrical module support assembly for use with a junction box recessed under the structure surface of a building. The universal modular support bracket assembly includes a mounting fastener. The universal modular support bracket assembly also includes an electrical module having a mounting portion with a module fastener aperture disposed through the mounting portion. The universal modular support bracket assembly also includes a support bracket having a longitudinal axis and a lateral axis disposed perpendicular to the longitudinal axis. The support bracket has a modular face, a junction box face opposite the modular face, and a bracket fastener aperture disposed through the support bracket. Also, the support bracket may extend beyond the mounting portion of the electrical module in directions along longitudinal and lateral axes. These configurations enable the support bracket to be relatively securely engaged to many types of standard electrical modules, including a light switch, dimmer switch, and outlet socket panel. The universal modular support bracket assembly is further innovative in that the support bracket is rotatably disposable between the mounting portion of an electrical module and a structure surface, with the modular face of the support bracket disposed towards the electrical module. This feature enables the support bracket to provide added support in relatively securing an electrical module to all of the surfaces of a building structure, including its walls, ceiling or floor. A plurality of overlapping support brackets corresponding to a plurality of electrical modules may also provide added support in securing the electrical modules to the structure surface. The added support provided by the support bracket to the electrical module mitigates damage to the underlying paint and drywall on the structure surface in the form of chipping and gouging resulting from the slippage or rubbing of the electrical module against the structure surface. The mounting fastener is disposed through the module fastener aperture of the electrical module and the bracket fastener aperture of the support bracket to relatively secure the electrical module to the junction box. The combination of the added support to the electrical module provided by the support bracket as well as its further securing by the mounting fastener uniquely helps mitigate the likelihood of the electrical module from falling into the opening created for the junction box in the structure surface, as commonly occurs with prior art devices.

According to other embodiments, the support bracket may be substantially rectangular. The support bracket may have a first longitudinal edge, a second longitudinal edge, a first lateral edge and a second lateral edge, the first lateral edge and the second lateral edge being disposed between the first longitudinal edge and the second longitudinal edge. The junction box face may be disposable against the structure surface. The modular face may be disposed against the electrical module. In addition, the mounting fastener may be engagable with the junction box.

In yet further embodiments, the electrical module may define a main body with the mounting portion extending therefrom. The electrical module may be a light switch, for example. Further, the electrical module may be a dimmer switch. The electrical module may also be an outlet socket panel, for example. The mounting portion of the electrical module may have an upper mounting portion with the module fastener aperture disposed through the upper mounting portion, and a lower mounting portion with the module fastener aperture disposed through the lower mounting portion.

According to another embodiment of the present invention, the universal modular support bracket assembly further includes a second electrical module having a second mounting portion with a second module fastener aperture disposed through the second mounting portion. The universal modular support bracket assembly may include a second support bracket defining a longitudinal axis and a lateral axis disposed perpendicular to the longitudinal axis. The second support bracket may have a modular face, a junction box face opposite the modular face, and a bracket fastener aperture disposed through the second support bracket. The second support bracket may be rotatably disposable between the mounting portion and the structure surface with the modular face disposed toward the electrical module. The second support bracket may extend beyond the mounting portion in directions along longitudinal and lateral axes away from the second support bracket. The mounting fastener may be disposed through the module fastener aperture and the bracket fastener aperture of the second support bracket. In addition, the universal modular support bracket assembly may include a plurality of electrical modules with each of the electrical modules having a mounting portion with a module fastener aperture disposed through the mounting portion. The universal modular support bracket assembly may likewise include a plurality of support brackets with each of such brackets corresponding to the mounting portion on the electrical modules.

In other embodiments, the support bracket may be made of metal. The support bracket may have a width of at least ⅝ in., for example. The support bracket may have a length of at least 2 7/16 in., for example.

In a further embodiment of the present invention, the universal modular support bracket assembly may further include a face plate, with the mounting portion of the electrical module being disposed between the face plate and the support bracket. In another embodiment, the support bracket may not extend beyond the face plate.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The drawings referred to herein are for the purpose of illustrating the preferred embodiments of the present invention and not for the purpose of limiting the same.

Figures 1, 2:
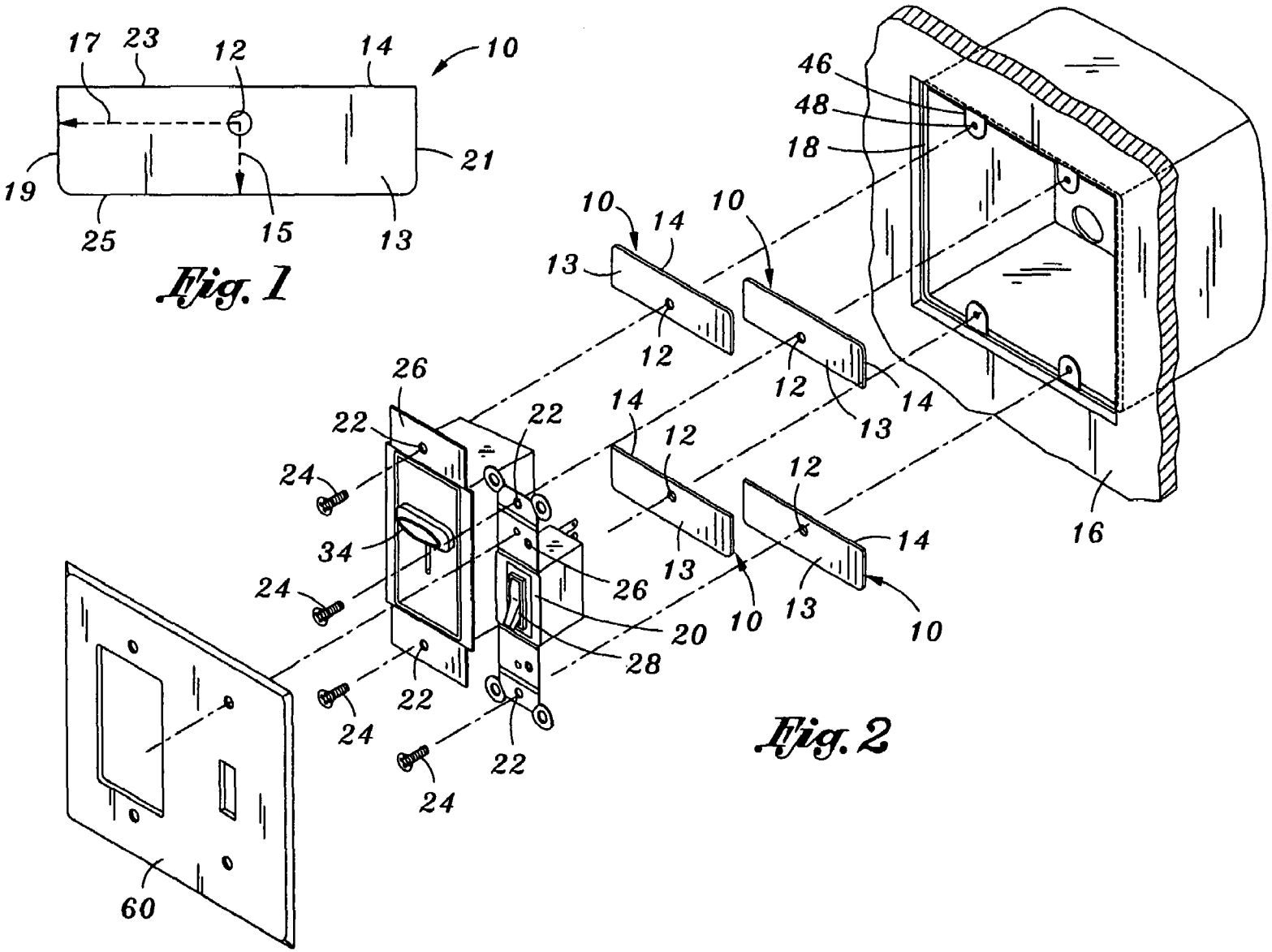
FIG. 1 is a drawing of the support bracket of the electrical module support assembly.
FIG. 2 is an exploded top view of an electrical module support assembly depicting a plurality of mounting fasteners, electrical modules and support brackets engaged with a standard cover plate and junction box recessed into the opening of a building's surface.

FIG. 1 is a drawing of the support bracket 10 of the electrical module support assembly. In one embodiment, the support bracket 10 may be defined by a longitudinal axis 15 and a lateral axis 17 disposed perpendicular to the longitudinal axis 15. The support bracket may have a modular face 13, a junction box face 14 opposite the modular face 13, and a bracket fastener aperture 12 disposed through the support bracket 10. This configuration may enable the support bracket 10 to be relatively securely engaged to many different types of electrical modules 20, including a light switch 28, a dimmer switch 34 and an outlet socket panel 40, and/or other standard electrical modules.

Although the support bracket 10 of the electrical module support assembly may have any shape, another embodiment of the electrical module support assembly may have a support bracket 10 which is of a substantially rectangular shape. The support bracket 10 may alternatively include a first longitudinal edge 19, a second longitudinal edge 21, a first lateral edge 23, and a second lateral edge 25, with the first lateral edge 23 and the second lateral edge 25 being disposed between the first longitudinal edge 19 and the second longitudinal edge 21.

A further embodiment of the support bracket 10 of the universal support bracket assembly may have a length from the first longitudinal edge 19 to the second longitudinal edge 21 of at least 2 7/16 in., for example. In yet another embodiment, the support bracket 10 may have a width from the first lateral edge 23 to the second lateral edge 25 of at least ⅝ in., for example.

Although the support bracket 10 may be made of any material, another embodiment of the support bracket 10 may be made of a metal or metal alloys, including steel and aluminum.

Referring now to FIG. 2, the support bracket 10 may extend beyond the mounting portion 26 of the electrical module 20 in directions respectively along the longitudinal axis 15 and lateral axis 17 of the support bracket 10 away from the support bracket 10. The modular face 13 of the support bracket 10 may be disposed towards the electrical module 20. In these embodiments, the support bracket 10 may provide still further support in relatively securing the electrical module 20 to the structure surface 16, thereby mitigating damage to the underlying paint and drywall on the structure surface 16 by chipping and gouging caused by a loose electrical module 20 rubbing against the structure surface 16.

The mounting fastener 24 may be disposed through the module fastener aperture 22 of the electric module 20 and the bracket fastener aperture 12 of the support bracket 10. In this embodiment, the universal support bracket assembly is able to mitigate the likelihood that the electrical module 20 will fall into the opening created for the junction box 18 in the structure surface 16.

The universal support bracket assembly may alternatively have the junction box face 14 of the support bracket 10 be rotatably disposable against the structure surface 16 within which the junction box 18 is recessed.

The modular face 13 of the support bracket 10 may be disposed against the electrical module 20.

Another embodiment of the universal support bracket assembly may include the mounting fastener 24 being engagable with the junction box 18.

The universal support bracket assembly may alternatively include a face plate 60 with the mounting portion 26 of the electrical module 20 being disposed between the face plate 60 and the support bracket 10. In yet another embodiment, the length of the support bracket 10 from the first longitudinal edge 19 to the second longitudinal edge 21 and the width of the support bracket 10 from the first lateral edge 23 to the second lateral edge 25 may not extend beyond the face plate 60.

Figure 6:
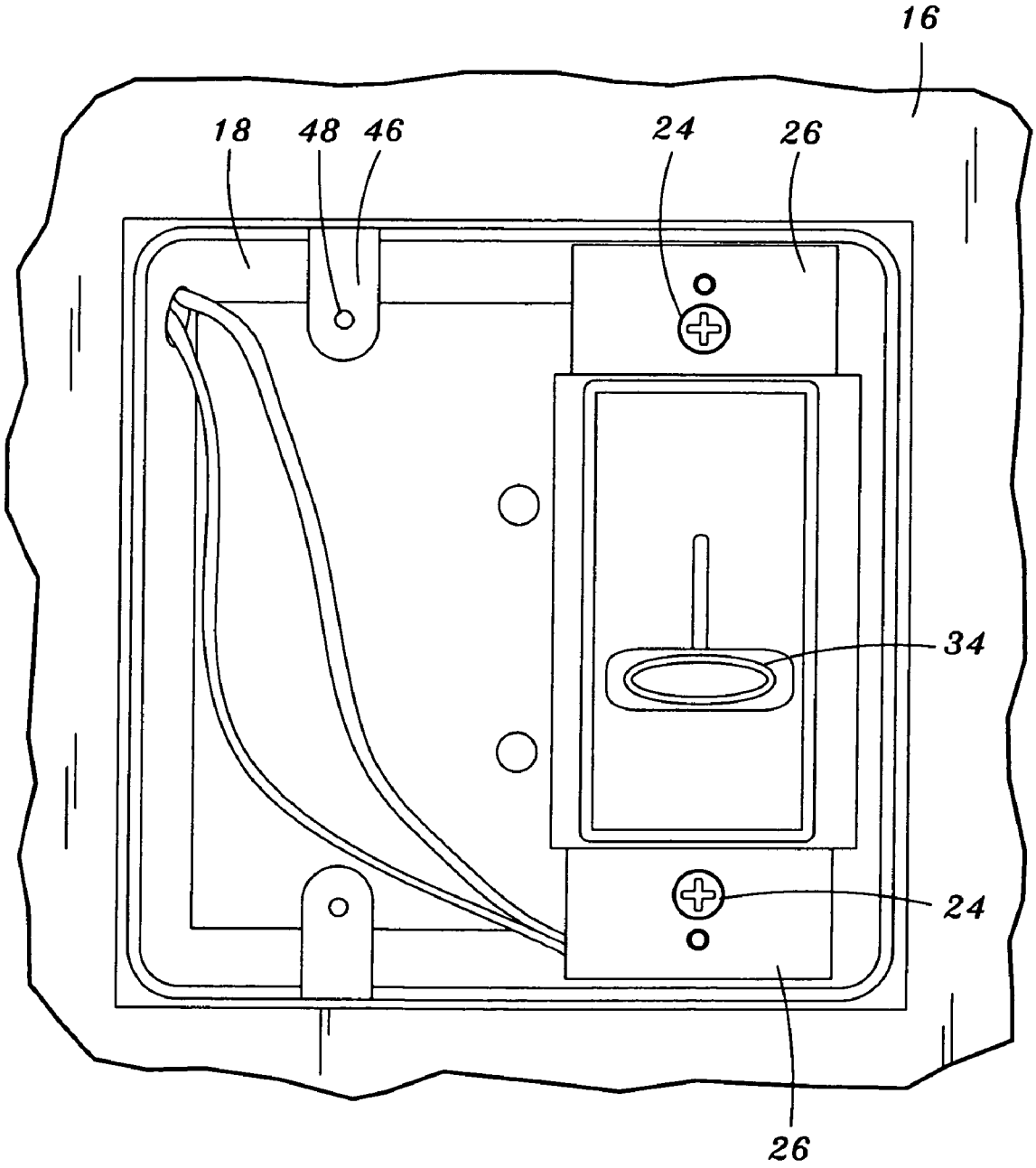
FIG. 6 is an exploded view of the junction box and its junction box extension depicting the point of engagement with the mounting fastener and mounting portion of an electrical module.

Referring still to FIG. 2 as well as FIG. 6, an embodiment of the universal support bracket assembly depicts the mounting fastener 24 disposed through the module fastener aperture 22 of the electrical module 20 and the bracket fastener aperture 12 of the support bracket 10 and coupled to the junction box 18 through a junction box aperture 48 located on a junction box extension 46 proximate to the edge of the junction box 18.

Figure 3:
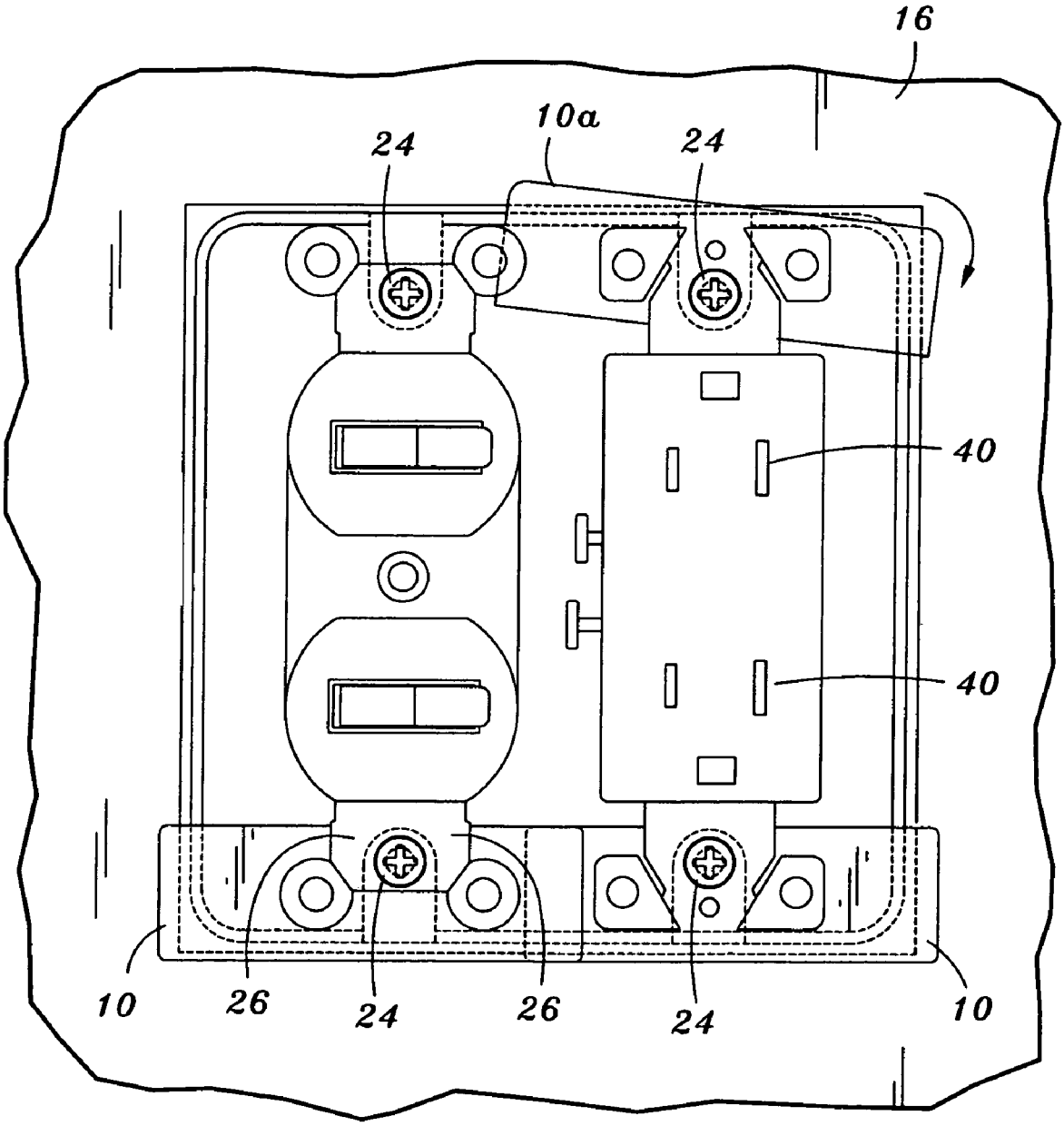
FIG. 3 is an exploded view of a second embodiment of an electrical module support assembly showing the engagement of two types of electrical modules with three support brackets by four mounting fasteners onto a structure surface and relatively secured to the recessed junction box, with the support brackets shown to be overlapping with each other and one support bracket shown to be rotatably disposable between the electrical module and the structure surface.

Referring still to FIG. 2 as well as FIG. 3, the support bracket 10*a* may be rotatably disposable between the mounting portion 26 of the electrical module 20 and the structure surface 16. In this embodiment, the support bracket 10 provides further added support in relatively securing the electrical module 20 to the structure surface 16, which may include a building's wall, floor, or ceiling.

FIG. 3 also depicts an electrical module 20 that may be an outlet socket panel 40, for example.

Figure 4:
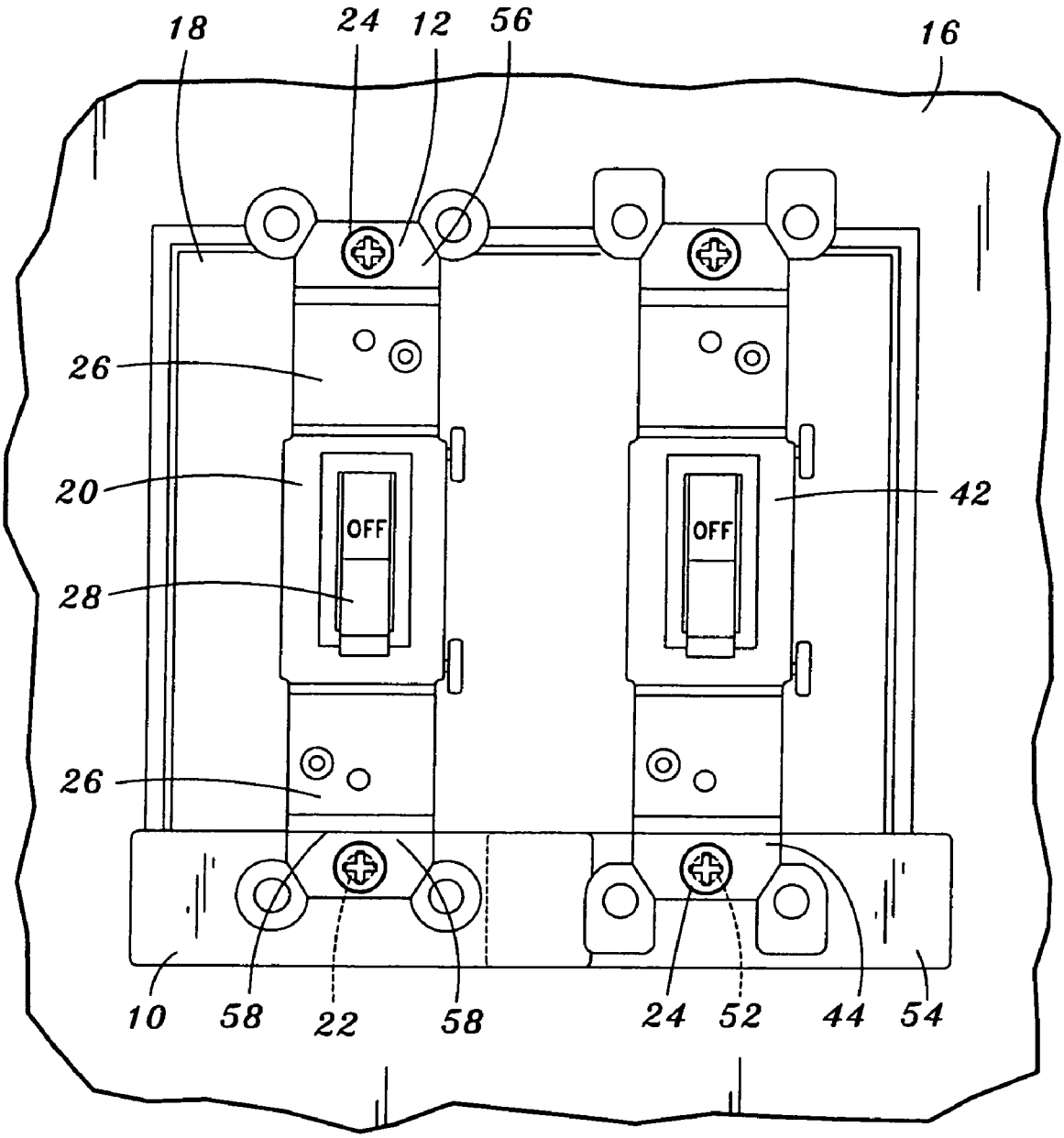
FIG. 4 is an exploded view of another embodiment of an electrical module support assembly showing two electrical modules with their corresponding support brackets, and depicting the upper and lower mounting portions of these electrical modules.

Referring now to FIG. 4, the universal support bracket assembly may alternatively include a second electrical module 42. In this embodiment, the second electrical module 42 includes a second mounting portion 44 and a second module fastener aperture 52 disposed through the second mounting portion 44 of the second electrical module 42. Still referring to FIGS. 1 and 4, the universal support bracket assembly having a second electrical module 42 may also include a second support bracket 54 having a longitudinal axis 15 and a lateral axis 17 disposed perpendicular to the longitudinal axis 15, with the second support bracket 54 having a modular face 13, a junction box face 14 opposite the modular face 13, and a bracket fastener aperture 12 disposed through the second support bracket 54. In this embodiment, the second support bracket 54 may be rotatably disposable between the second mounting portion 44 and the structure surface 16 with the modular face 13 of the second support bracket 54 disposed towards the second electrical module 42. Further, in this embodiment, the second support bracket 54 may extend beyond the second mounting portion 44 in directions respectively along the longitudinal axis 15 and lateral axis 17 of the second support bracket 54 away from the second support bracket 54. The mounting fastener 24 may be disposed through the second module fastener aperture 52 and the bracket fastener aperture 12. As discussed above, these features enable the second support bracket 54 to provide added support in relatively securing the second electrical modules 42 to which it corresponds to the structure surface 16. Further, in this embodiment, the overlap of the second support bracket 54 with the support bracket 10 provides additional support in relatively securing the electrical module 20 and second electrical module 42 to the structure surface 16.

The electrical module 20 of the universal support bracket assembly may include a mounting portion 26 having an upper mounting portion 56 with the module fastener aperture 22 disposed through the upper mounting portion 56, and a lower mounting portion 58 with the module fastener aperture 22 disposed through the lower mounting portion 58.

FIG. 4 also depicts an embodiment of the universal support bracket assembly that may include an electrical module 20 that is a light switch 28, for example.

Figure 5:
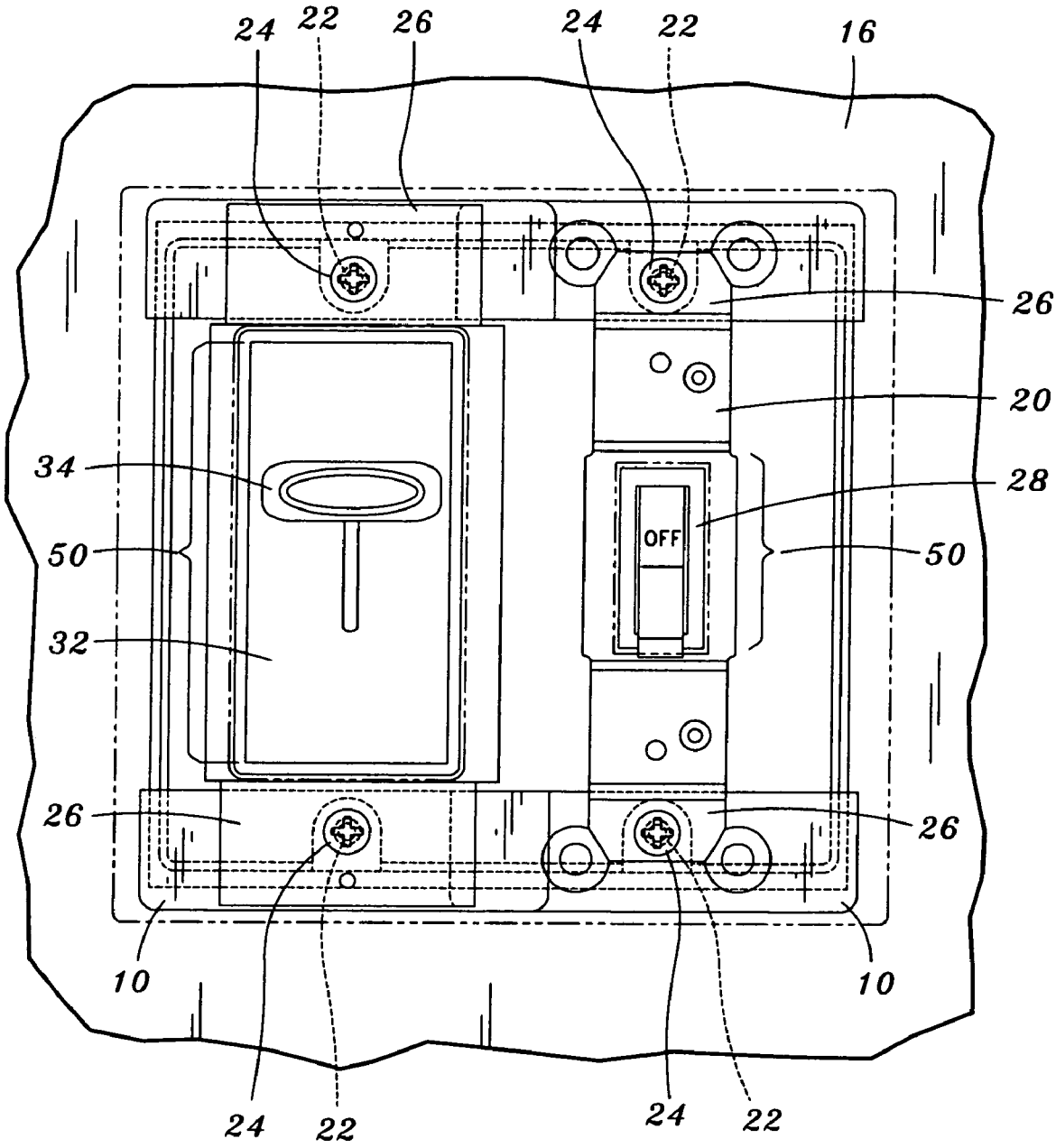
FIG. 5 is an exploded view of another embodiment of an electrical module support assembly with two additional types of electrical modules with their corresponding support brackets, also depicting the main body of these electrical modules.

Referring now to FIG. 5, each electrical module 20 may include a main body 50 with the mounting portion 26 extending from the main body 50.

FIGS. 5 and 6 also depict an electrical module 20 that may be a dimmer switch 34, for example.

Figure 7:
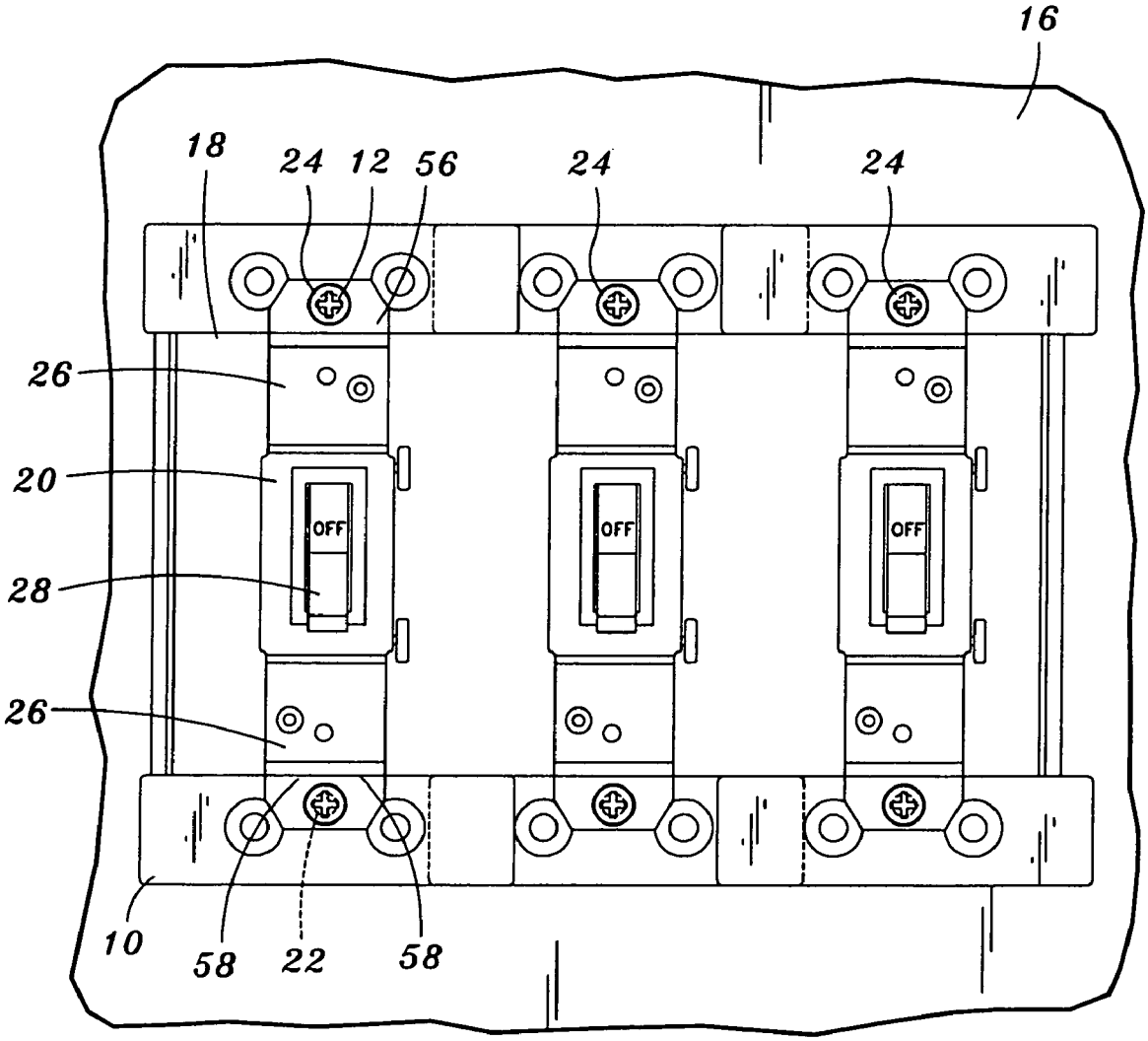
FIG. 7 is an exploded view of another embodiment of the universal support bracket assembly depicting a plurality of electrical modules engaged with a plurality of support brackets supported on a structure surface and relatively secured to a junction box.

Referring now to FIG. 7, the universal support bracket assembly may alternatively include a plurality of electrical modules, each electrical module 20 having a mounting portion 26 with a module fastener aperture 22 disposed through the mounting portion 26. The universal support bracket assembly may further include a plurality of support brackets, each support bracket 10 corresponding to the mounting portion 26 on each electrical module 20. The overlap of each additional support bracket 10 with an additional support bracket 10 provides support in relatively securing the electrical module 20 to the structure surface 16.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electrical module support assembly for use with a junction box disposed in a building structure at a structure surface, the assembly comprising:

a mounting fastener;

an electrical module having a mounting portion, the mounting portion having an upper mounting portion and an opposing lower mounting portion, the upper mounting portion having an upper module fastener aperture disposed through the upper mounting portion, the lower mounting portion having a lower module fastener aperture disposed through the lower mounting portion; and a substantially rectangular support bracket defining a longitudinal axis and a lateral axis disposed perpendicular to the longitudinal axis, the support bracket having a modular face, a junction box face opposite the modular face, and a bracket fastener aperture disposed through the support bracket, the support bracket being rotatably disposable between the mounting portion and the structure surface with the modular face disposed towards the electrical module with the mounting fastener disposed through the module fastener aperture and the bracket fastener aperture, the support bracket extending beyond the mounting portion in directions respectively along the longitudinal and lateral axes away from the support bracket with the mounting fastener disposed through either the upper or lower module fastener aperture and the bracket fastener aperture.

2. The assembly as claimed in claim 1, wherein the junction box face is disposable against the structure surface.

3. The assembly as claimed in claim 1, wherein the modular face is disposed against the electrical module.

4. The assembly as claimed in claim 1, wherein the mounting fastener is engagable with the junction box.

5. The assembly as claimed in claim 1, wherein the support bracket has a first longitudinal edge, a second longitudinal edge, a first lateral edge, and a second lateral edge, the first lateral edge and the second lateral edge being disposed between the first longitudinal edge and the second longitudinal edge.

6. The assembly as claimed in claim 1, wherein the electrical module is a light switch.

7. The assembly as claimed in claim 1, wherein the electrical module is a dimmer switch.

8. The assembly as claimed in claim 1 wherein the electrical module is an outlet socket panel.

9. The assembly as claimed in claim 1 further comprises a second electrical module, the second electrical module having a second mounting portion, the second mounting portion having a second upper mounting portion and an opposing second lower mounting portion, the second upper mounting portion having a second upper module fastener aperture disposed through the second upper mounting portion, the second lower mounting portion having a second lower module fastener aperture disposed through the second lower mounting portion.

10. The assembly as claimed in claim 9 further comprises a second support bracket, the second support bracket defining a longitudinal axis and a lateral axis disposed perpendicular to the longitudinal axis, the second support bracket having a modular face, a junction box face opposite the modular face, and a bracket fastener aperture disposed through the second support bracket, the second support bracket being rotatably disposable between the second mounting portion and the structure surface with the modular face disposed towards the electrical module, the second support bracket extending beyond the second mounting portion in directions respectively along the longitudinal and lateral axes away from the second support bracket, with the mounting fastener disposed through the second module fastener aperture and the bracket fastener aperture.

11. The assembly as claimed in claim 1 further comprises a plurality of electrical modules, each of the electrical modules having a mounting portion with a module fastener aperture disposed through the mounting portion.

12. The assembly as claimed in claim 11 further comprises a plurality of support brackets, each of the support brackets corresponding to the mounting portion on the electrical modules.

13. The assembly as claimed in claim 1, wherein the electrical module has a main body with the mounting portion extending from the main body.

14. The assembly as claimed in claim 1, wherein the support bracket is made of metal.

15. The assembly as claimed in claim 1, wherein the support bracket has a width of at least 5/8 in.

16. The assembly as claimed in claim 1, wherein the support bracket has a length of at least 2 7/16 in.

17. The assembly as claimed in claim 1 further comprises a face plate, the mounting portion of the electrical module being disposed between the face plate and the support bracket.

18. The assembly as claimed in claim 17, wherein the support bracket does not extend beyond the face plate.

* * * * *